US008721057B2

(12) United States Patent
Gunnell

(10) Patent No.: US 8,721,057 B2
(45) Date of Patent: May 13, 2014

(54) SYSTEM FOR TRANSPORTING PHASE CHANGE INK USING A THERMOELECTRIC DEVICE

(71) Applicant: Xerox Corporation, Norwalk, CT (US)

(72) Inventor: Reid Wayne Gunnell, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 13 days.

(21) Appl. No.: 13/649,754

(22) Filed: Oct. 11, 2012

(65) Prior Publication Data

US 2014/0104333 A1 Apr. 17, 2014

(51) Int. Cl.
*B41J 2/175* (2006.01)
*B41J 2/195* (2006.01)

(52) U.S. Cl.
USPC ..... 347/85; 347/7

(58) Field of Classification Search
USPC ..... 347/5, 7, 17, 18, 19, 85–87
See application file for complete search history.

(56) References Cited

U.S. PATENT DOCUMENTS 4,751,528 A 6/1988 Spehrley, Jr. et al.
5,418,557 A * 5/1995 Pullen ..... 347/7
5,622,897 A 4/1997 Hayes
6,007,193 A * 12/1999 Kashimura et al. ..... 347/92
6,007,302 A 12/1999 Welle
6,213,596 B1 * 4/2001 Nowell et al. ..... 347/85
6,575,547 B2 * 6/2003 Sakuma ..... 347/18
6,648,443 B1 11/2003 Rausch et al.
6,860,591 B2 * 3/2005 Slotto et al. ..... 347/85
7,090,323 B2 * 8/2006 Takatsuka ..... 347/17
7,416,292 B2 8/2008 Leighton
7,757,716 B2 7/2010 Welle
8,136,909 B2 3/2012 Ogasawara et al.
2010/0245506 A1 9/2010 Platt et al.
2012/0081484 A1 4/2012 Price et al.

* cited by examiner

*Primary Examiner* — Anh T. N. Vo

(74) *Attorney, Agent, or Firm* — Maginot, Moore & Beck, LLP

(57) ABSTRACT

An ink transport system for a phase change ink printer has been developed that enables accurate control of refilling a second ink reservoir from a first ink reservoir with minimal moving parts. The system includes a thermoelectric device that is operatively connected to a thermally conductive tube, which fluidly connects the first and second ink reservoirs. The thermoelectric device is operated by a controller to heat phase change ink in the thermally conductive tube and enable flow of ink from the first reservoir to the second reservoir, and to remove heat from the phase change ink in the thermally conductive tube to solidify ink in the tube and disable flow of ink from the first reservoir to the second reservoir.

18 Claims, 4 Drawing Sheets

SYSTEM FOR TRANSPORTING PHASE CHANGE INK USING A THERMOELECTRIC DEVICE

TECHNICAL FIELD

This disclosure relates generally to phase change ink printers, and, in particular, to ink transport systems within phase change ink printers.

BACKGROUND

In general, inkjet printers include at least one printhead configured with an array of inkjet ejectors that are operated to eject drops of liquid ink onto an image receiving surface. A phase-change inkjet printer employs phase change inks that are solid at ambient temperature, but transition to a liquid phase at an elevated temperature. The melted ink can then be ejected by the inkjet ejectors in a printhead to form an ink image on the image receiving surface. The image receiving surface may be an intermediate imaging member, such as a rotating drum or belt, on which a layer of release agent has been applied. After the ink image is formed on the release agent layer, the image is then transferred to an image receiving substrate, such as a sheet of paper, as the substrate passes through a nip formed between a transfix roller and the intermediate imaging member. In other printing systems, the ink can be ejected directly onto printing media as the media moves past the printheads.

As already noted above, phase change ink is loaded into a printer in solid form, transported to a melting device, and melted to produce liquid ink. The melted ink can be stored in a reservoir that can be either internal or external to a printhead. Some printers include both internal and external reservoirs, with the reservoir internal to the printhead(s) refilling from the external reservoir when the ink in the internal reservoir is low.

In phase change inkjet printers having multiple printheads, the ink is used at varying rates by each printhead. These varying rates of use necessitate independent refilling of the internal ink reservoir of each printhead. Previous printers used a series of ball valves, flapper valves, solenoids, pressure sources, and other mechanical hardware to enable individual refilling of each internal reservoir from the external reservoir. However, the mechanical ink transport systems can be slow at responding to changes in ink levels in the internal reservoirs, and the mechanical transport systems have a large number of parts that can malfunction. Thus, improved transport of liquid ink in a phase change ink printer is desirable.

SUMMARY

In one embodiment an ink transport system enables accurate refilling of a second ink reservoir from a first ink reservoir with minimal moving parts. The ink transport system comprises a thermally conductive tube, a thermoelectric device, and a controller. The thermally conductive tube has a first end that is fluidly connected to a first ink reservoir and a second end that is fluidly connected to a second ink reservoir to enable transport of melted phase change ink between the first ink reservoir and the second ink reservoir. The thermoelectric device is operatively connected to the thermally conductive tube and the controller is operatively connected to the thermoelectric device. The controller is configured to selectively operate the thermoelectric device to heat the thermally conductive tube to melt phase change ink within the tube to enable the phase change ink to flow from the first ink reservoir to the second ink reservoir, and to remove heat from the thermally conductive tube to solidify the melted phase change ink within the tube to disable flow of the phase change ink from the first ink reservoir to the second ink reservoir.

In another embodiment an ink transport system enables accurate refilling of ink reservoirs internal to a plurality of printheads from a first ink reservoir with minimal moving parts. The ink transport system comprises a first ink reservoir, a plurality of printheads, a plurality of thermally conductive tubes, a plurality of thermoelectric devices, and a controller. The first ink reservoir configured to hold a supply of phase change ink, while each printhead in the plurality of printheads includes at least one internal ink reservoir. Each tube in the plurality of thermally conductive tubes has a first end that is fluidly connected to the first ink reservoir to enable melted phase change ink from the first reservoir to enter each tube in the plurality of thermally conductive tubes. Each tube in the plurality of thermally conductive tubes further includes a second end that is fluidly connected to only one of the at least one internal ink reservoir in the plurality of printheads. Each second end of each thermally conductive tube is connected to a different internal ink reservoir than the other second ends of the other thermally conductive tubes in the plurality of thermally conductive tubes to enable each tube in the plurality of thermally conductive tubes to supply melted phase change ink to only one internal ink reservoir of one printhead in the plurality of printheads. Each thermoelectric device in the plurality of thermoelectric devices is operatively connected to only one of the thermally conductive tubes and each thermoelectric device is operatively connected to a thermally conductive tube that is different than the thermally conductive tubes to which the other thermoelectric devices in the plurality of thermoelectric devices are operatively connected. The controller is operatively connected to each thermoelectric device in the plurality of thermoelectric devices. The controller is configured to selectively operate each thermoelectric device independently of the other thermoelectric devices in the plurality of thermoelectric devices to heat independently each thermally conductive tube to melt phase change ink within each tube to enable melted phase change ink to flow from the first ink reservoir to the internal ink reservoir to which the tube is fluidly connected, and to remove heat independently from each thermally conductive tube to solidify the melted phase change ink within the tube to disable flow of the phase change ink from the first ink reservoir to the internal ink reservoir to which the tube is fluidly connected.

DETAILED DESCRIPTION

Figure 1:
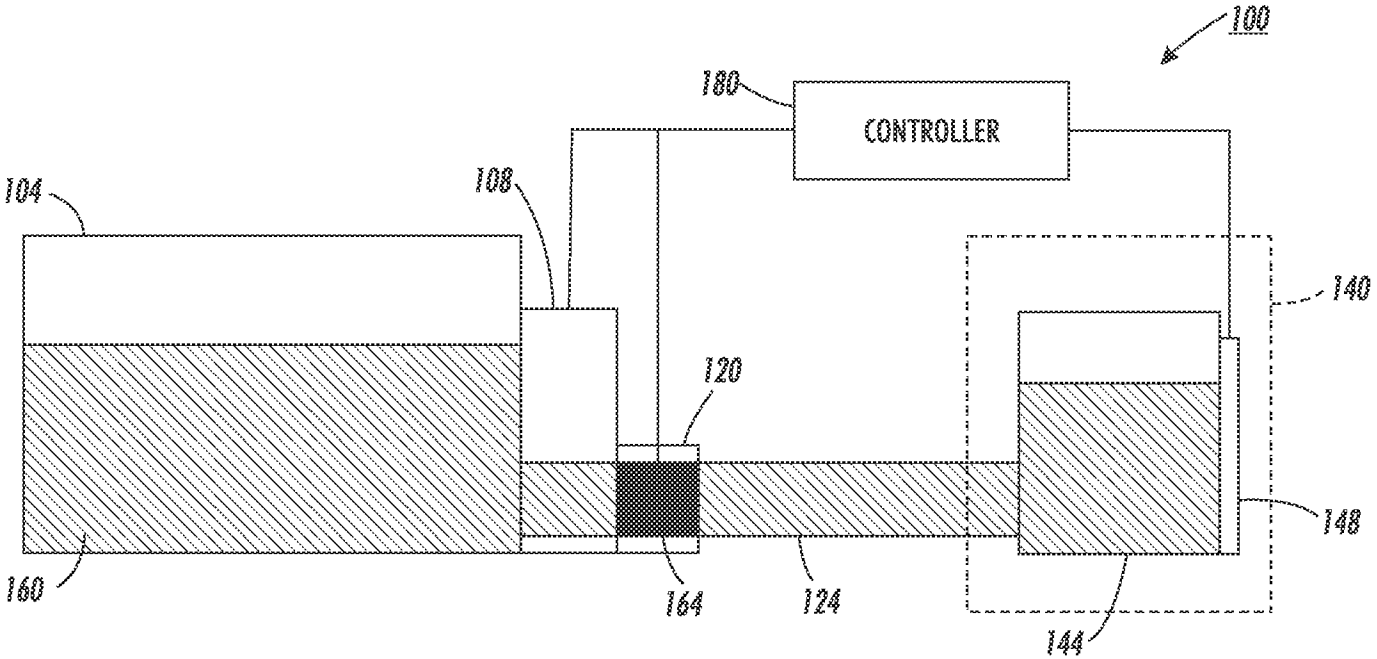
FIG. 1 is a schematic view of an ink transport system for a printer.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Phase change ink printers use phase change ink, also referred to as a solid ink, which is in a solid state at room temperature but melts into a liquid state at a higher operating temperature.

The term "printhead" as used herein refers to a component in the printer that is configured with an array of inkjet ejectors that are operated by firing signals to eject ink drops onto an image receiving surface. The firing signals operate actuators in the inkjet ejectors to expel ink through the nozzles of the inkjet ejectors. In some embodiments, the inkjets in an array of inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that enables formation of an ink image, moves past the printheads in a process direction through the print zone. The inkjets in the printheads eject ink drops in rows in a cross-process direction, which is perpendicular to the process direction across the image receiving surface.

FIG. 1 is a schematic diagram of an ink transport system 100 installed in a printer. The ink transport system 100 includes an external reservoir 104, a printhead 140, a thermally conductive tube 124, which fluidly connects the external reservoir to the printhead 140, and a controller 180. The external reservoir 104 is configured to store a volume of liquid ink 160, and includes a heater (not shown) to enable ink in the external reservoir 104 to remain in a liquid state. In some embodiments, the external reservoir can be configured to receive melted ink from an ink melt plate, which melts solid ink sticks or pellets inserted into an ink delivery system of the printer, to supply the external reservoir with liquid phase change ink. In other embodiments, the external reservoir can be positioned to enable solid phase change ink to be delivered directly to the external reservoir, where the ink melts in the heated reservoir.

The printhead 140 includes an internal reservoir 144 and an ink level sensor 148. The internal reservoir 144 is fluidly connected to a plurality of inkjets that terminate in apertures on a faceplate of the printhead 140 to enable the internal reservoir 144 to supply liquid phase change ink to the inkjets for ejection through the apertures or nozzles onto an image receiving surface. The ink level sensor 148 is operatively connected to the internal ink reservoir 144, and is configured to detect the amount of ink in the internal reservoir 144 and generate an electrical signal corresponding to the amount of ink detected. The ink level sensor 148 can be any suitable sensor for determining the amount of ink in the internal reservoir 144, for example, a float sensor, an optical sensor, a capacitive sensor, a pressure transducer, an electrical resistance sensor, a thermistor, or a thermocouple.

The thermally conductive tube 124 is operatively connected to the external and internal ink reservoirs to fluidly connect the reservoirs. The tube 124 includes a thermoelectric device 120 and a pressure source 108. In the embodiment of FIG. 1, the pressure source is a pump configured to move the liquid ink through the tube 124, although any suitable pressure source capable of urging the liquid ink from the external reservoir through the thermally conductive tube to the internal reservoir can be used. The thermoelectric device 120 is a thermoelectric cooler ("TEC"), also known as a Peltier device, which includes alternating P-type and N-type semiconductors electrically connected in series in a manner known in the art to enable the device 120 to pull heat from one side of the device and expel heat from the other side of the thermoelectric device 120 when an electric current is applied through the device 120. The heat flow in the thermoelectric device 120 is reversible, such that reversing the direction of the current applied to the device 120 switches the direction of heat flow through the device 120. By controlling the direction of electrical current through the device 120, the device 120 can selectively heat or cool the surface to which it is attached. The thermoelectric device 120 is positioned to enable one side to contact the thermally conductive tube 124, while the other side of the device 120 is attached to a heat sink to enable the device 120 to dissipate heat. Thus, application of an electric current having a first polarity through the thermoelectric device 120 removes heat from the heat sink and heats the thermally conductive tube 124, while application of an electric current having an opposite polarity to the first polarity removes heat from the thermally conductive tube 124 and expels heat into the heat sink. In other embodiments, the side of the thermoelectric device not coupled to the thermally conductive tube can be open to atmosphere or thermally connected to an ink reservoir to enable the thermoelectric device to supply heat to the ink reservoir while cooling the tube.

The controller 180 is operatively connected to the ink level sensor 148, the thermoelectric device 120, and the pressure source 108. The controller 180 receives the electrical signal generated by the ink level sensor 148, and, based on the level of ink detected by the sensor 148, the controller 180 is configured to determine the direction or polarity of the current to be supplied to the thermoelectric device 120. For example, when the ink level in the internal reservoir is low, the controller 180 operates the thermoelectric device 120 to heat the tube, melting the ink in the tube 124. The controller is further configured to activate the pressure source 108 while the ink in the tube 124 is in a liquid state to urge the liquid ink 160 from the external reservoir 104 through the tube 124 to the internal reservoir 144 of the printhead 140. Once the reservoir is full, the controller is configured to reverse the polarity of the power supplied to the thermoelectric device 120 to remove heat from the thermally conductive tube 124, solidifying the ink in the tube 124 and blocking the flow of ink from the external reservoir 104 to the internal reservoir 144.

In operation, the amount of ink in the printhead internal reservoir 144 decreases as the printhead 140 ejects ink onto image receiving members or performs maintenance operations that use ink. The ink level sensor 148 generates a signal corresponding to the amount of ink in the internal reservoir 144 at predetermined intervals, and delivers the signal to the controller 180. Once the sensor detects that the ink level in the internal reservoir 144 is below a lower threshold, the controller activates the thermoelectric device 120 to apply heat to the thermally conductive tube 124, melting solid ink 164 that is in the thermally conductive tube 124. The controller activates the pressure source 108 to urge the liquid ink 160 from the external reservoir, through the thermally conductive tube 124, where ink has been liquefied by the thermoelectric device 120, and into the internal reservoir 144 of the printhead 140. When the ink level sensor 148 detects that the ink level in the internal reservoir 144 is above an upper threshold, the controller 180 deactivates the pressure source 108 and reverses the polarity of the electric power supplied to the thermoelectric device 120, which then removes heat from the thermally conductive tube 124. In response, the phase change ink 164 in the thermally conductive tube 124 solidifies, blocking the flow of ink through the tube 124.

Figure 2:
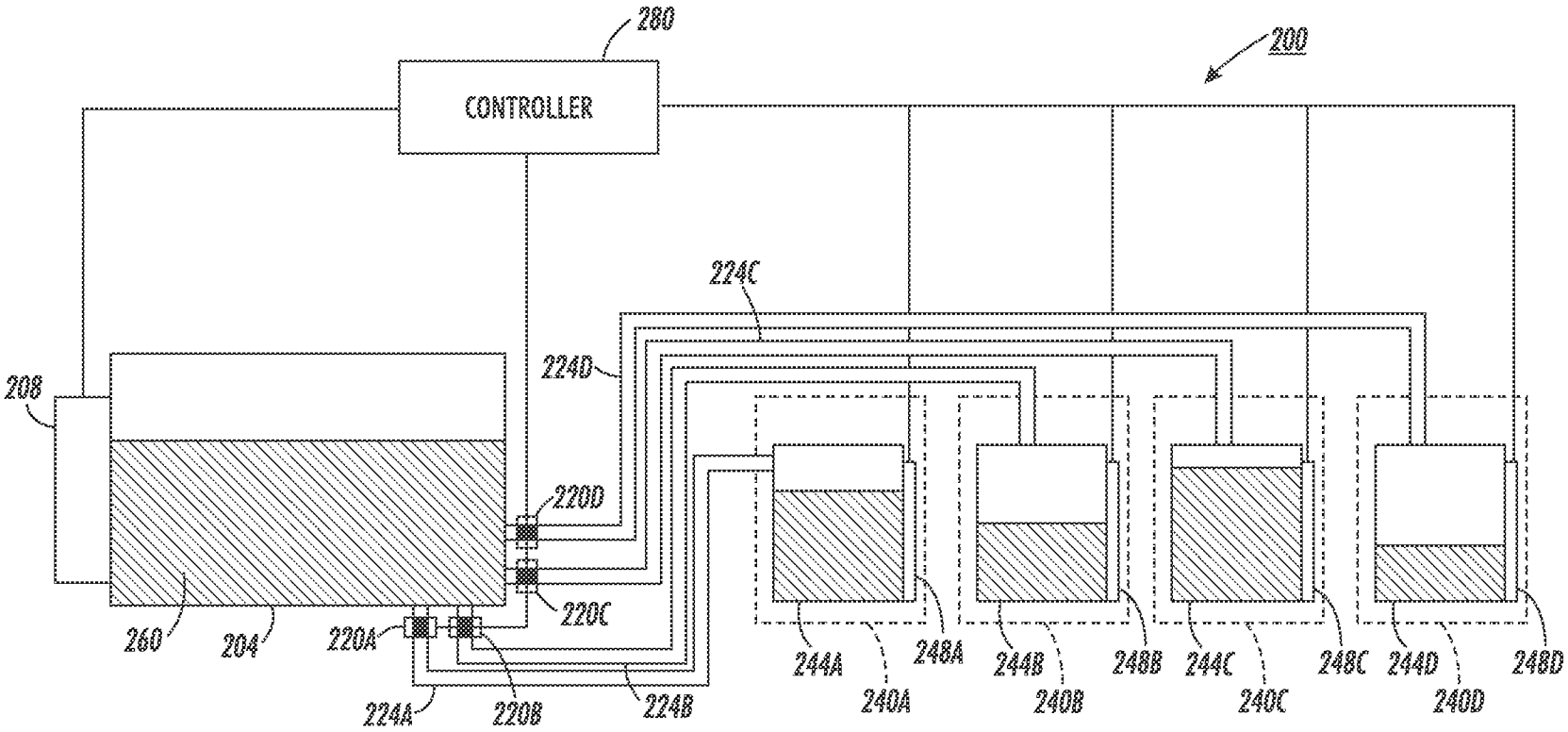
FIG. 2 is a schematic view of an ink transport system for a multi-printhead printer.

FIG. 2 is a schematic diagram of an ink transport system 200 for a printer having multiple printheads. The ink transport system 200 includes an external reservoir 204, four printheads 240A-D, four thermally conductive tubes 224 A-D, and a controller 280. While the embodiment of FIG. 2 includes four printheads, the reader should appreciate that the ink transport system can be used in a printer including any number of printheads. In addition, multiple ink transport systems can be installed in a single printer, for example, one transport system for each color of ink printed by the printer. In one embodiment, a printer has four printheads, each of which has four internal ink reservoirs, one for each CMYK (cyan, magenta, yellow, and black) color. The printer also has four ink transport systems, each having four thermoelectric devices and four thermally conductive tubes to convey each CMYK color to the appropriate internal ink reservoir of each printhead. Each transport system thus enables ink of a single color to be delivered to one reservoir in each of the four printheads corresponding to the color of the external reservoir coupled to the particular transport system.

The external reservoir 204 is configured to store a volume of liquid ink 260, and includes a heater (not shown) to enable ink in the external reservoir 204 to remain in a liquid state. In the embodiment of FIG. 2, the external reservoir 204 includes a pressure source 208, for example, an air compressor to pressurize the air inside the external reservoir 204 and enable the ink to flow from the external reservoir 204 toward the printheads 240A-D.

Each of the printheads 240A-D includes an internal reservoir 244A-D and an ink level sensor 248A-D. The internal reservoirs 244A-D are each fluidly connected to a plurality of inkjets located in apertures on a faceplate of the corresponding printhead 240A-D to enable the internal reservoirs 244A-D to supply ink to the inkjets for ejection onto an image receiving surface. Each ink level sensor 248A-D is operatively connected to one of the internal ink reservoirs 244A-D, and is configured to detect the amount of ink in the corresponding internal reservoir 244A-D and generate an electrical signal indicative of the amount of ink in the internal reservoir 244A-D.

The thermally conductive tubes 224A-D fluidly connect the external ink reservoir 204 with internal ink reservoirs 244A-D, respectively. The thermoelectric devices 220A-D of the illustrated embodiment are thermoelectric coolers, also known as Peltier devices, which include alternating P-type and N-type semiconductors electrically connected in series in a manner known in the art to enable the devices to pull heat from one side of the device and expel the heat from the other side of the thermoelectric device when an electric current is applied through the device. The thermoelectric devices 220A-D are reversible, such that reversing the direction of the current applied to the devices 220A-D reverses the direction of heat flow through the device 220A-D. The thermoelectric devices 220A-D are positioned to enable one side to contact the corresponding thermally conductive tube 224A-D, while the other side of the device 220A-D is connected to a heat sink. As noted above, in some configurations, the thermoelectric devices can be connected to the ink reservoir or open to ambient air on the other side of the device. Thus, application of an electric current having a first polarity through the thermoelectric devices 220A-D removes heat from the heat sink and heats the corresponding thermally conductive tube 224A-D, while application of an electric current having a polarity opposite to the first polarity removes heat from the thermally conductive tubes 224A-D and expels heat into the heat sink.

The controller 280 is operatively connected to the ink level sensors 248A-D, the thermoelectric devices 220A-D, and the pressure source 208. The controller 280 receives the electrical signal generated by each of the ink level sensors 248A-D, and, based on the level of ink detected by the sensors 248A-D, individually and independently determines the polarity of the power to supply to each of the thermoelectric devices 220A-D. When the controller 280 operates any of the thermoelectric devices 220A-D to heat one of the thermally conductive tubes 224A-D, the controller 280 is configured to activate the pressure source 208 and generate an elevated air pressure in the external reservoir 204 to enable flow of the liquid ink 260 from the external reservoir 204 toward the internal reservoirs 244A-D. The controller can be configured to activate the pressure source 208 immediately, or the controller can be programmed to delay before activating the pressure to enable the ink in the tube to melt before activating the pressure source. In another embodiment, the pressure source 208 can be active at all times when the printer is on. In some embodiments, the pressure source can be a fluid pressure source, for example, a gear pump, to urge ink from the external reservoir toward the internal reservoirs.

In operation, the amount of ink in the printhead internal reservoirs 244A-D decreases as the corresponding printhead 240A-D ejects ink onto image receiving surface(s) or performs maintenance operations that use ink. The amount of ink in each of the reservoirs 244A-D decreases at differing rates, depending on the amount of ink ejected by each printhead 240A-D, necessitating individual and independent control of the ink supplied to each printhead reservoir 244A-D. Each of the ink level sensors 248A-D generates a signal corresponding to the amount of ink in the corresponding internal reservoir 244A-D at predetermined intervals, and the signals are delivered to the controller 280. When one of the sensors 248A-D detects that the ink level in the corresponding internal reservoir 244A-D is below a lower threshold, the controller activates the corresponding thermoelectric device 220A-D to apply heat to the thermally conductive tube 224A-D and melt solid ink present in the corresponding thermally conductive tube 224A-D. The controller activates the pressure source 208 to urge the liquid ink 260 from the external reservoir 204, through the thermally conductive tube(s) 224A-D where ink has been liquefied by the heated thermoelectric device 220A-D, and into the internal reservoir 244A-D that the sensor 248A-D indicated as being low. When the ink level sensor 248A-D corresponding to the heated thermoelectric device 220A-D detects that the ink level in the internal reservoir 244A-D is above an upper threshold, the controller 280 reverses the polarity of the electric power supplied to the heated thermoelectric device 220A-D, which then begins cooling the corresponding thermally conductive tube 224A-D. The phase change ink in the cooled thermally conductive tube 224A-D solidifies, blocking the flow of ink through the tube and terminating the refill process.

Figure 3:
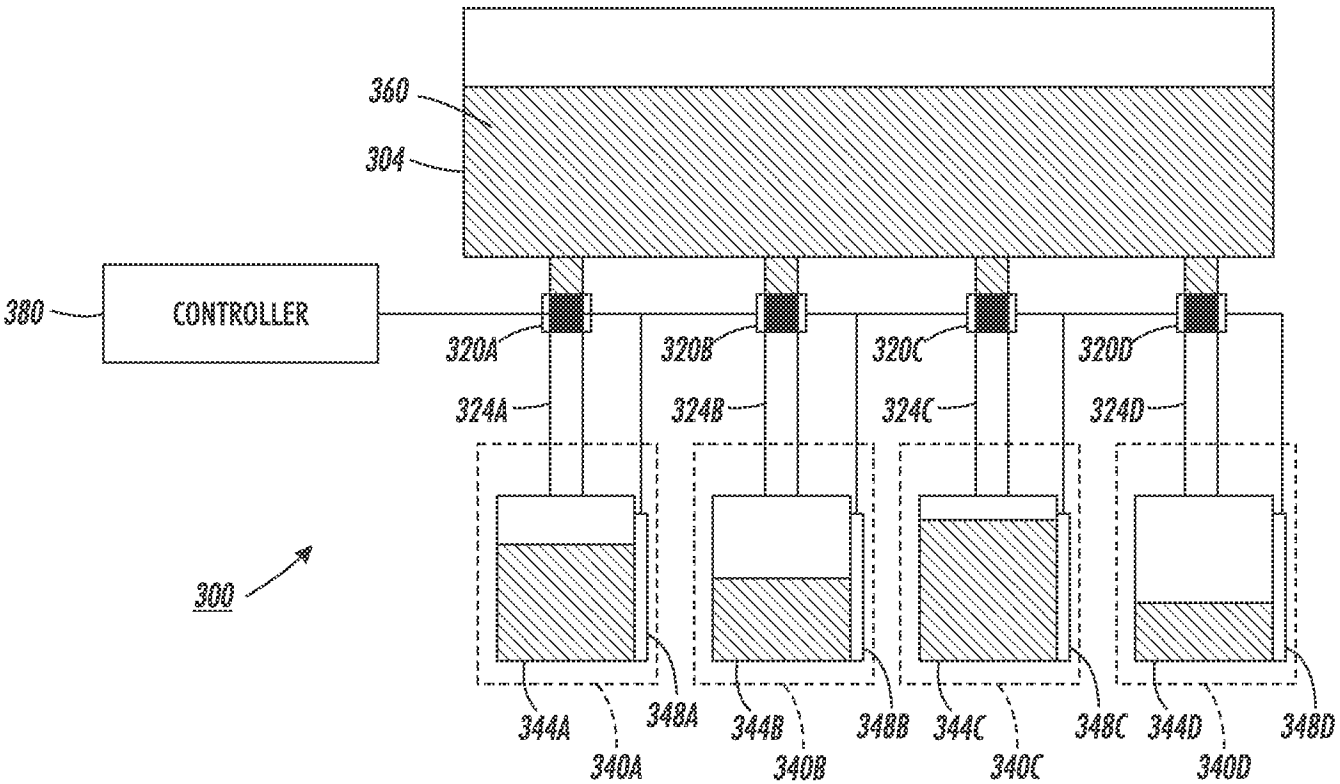
FIG. 3 is a schematic view of another ink transport system for a multi-printhead printer.

FIG. 3 is a schematic diagram of an ink transport system 300 for a printer having multiple printheads that does not use a pressure source to urge ink through the tubes to the printheads. The ink transport system 300 includes an external reservoir 304, four printheads 340A-D, four thermally conductive tubes 324 A-D, and a controller 380. The external reservoir 304 is configured to store a volume of liquid ink 360, and includes a heater (not shown) to enable ink in the external reservoir 304 to remain in a liquid state.

Each of the printheads 340A-D includes an internal reservoir 344A-D and an ink level sensor 348A-D. The internal reservoirs 344A-D are each fluidly connected to a plurality of inkjets located in apertures on a faceplate of the corresponding printhead 340A-D to enable the internal reservoirs 344A-D to supply ink to the inkjets for ejection onto an image receiving surface. Each ink level sensor 348A-D is operatively connected to one of the internal ink reservoirs 344A-D, and is configured to detect the amount of ink in the corresponding internal reservoir 344A-D and generate an electrical signal indicative of the amount of ink in the internal reservoir 344A-D.

The thermally conductive tubes 324A-D fluidly connect the external ink reservoir 304 with the corresponding internal ink reservoirs 344A-D. Each tube 324A-D includes a thermoelectric device 320A-D configured to remove heat from one side of the device and expel heat from the other side of the device when current is applied through the thermoelectric device. The thermoelectric devices 320A-D are positioned to enable one side to contact the corresponding thermally conductive tube 324A-D, while the other side of the device 320A-D is coupled to a heat sink. As noted above, in some configurations, the thermoelectric devices can be connected to the ink reservoir or open to ambient air on the other side of the device. Application of an electrical current having a first polarity through the thermoelectric devices 320A-D removes heat from the heat sink and applies heat to the corresponding thermally conductive tube 324A-D, while application of an electric current having a polarity opposite to the first polarity removes heat from the thermally conductive tube 324A-D and transfers heat to the heat sink.

The controller 380 is operatively connected to the ink level sensors 348A-D and the thermoelectric devices 320A-D. The controller 380 receives the electrical signals generated by the ink level sensors 348A-D, and, based on the level of ink detected by the sensors 348A-D, individually determines the polarity of the power supplied to each of the thermoelectric devices 320A-D.

In operation, the amount of ink in the printhead internal reservoirs 344A-D decreases as the corresponding printhead 340A-D ejects ink onto image receiving members or performs maintenance operations that use ink. The amount of ink in each of the reservoirs 344A-D decreases at differing rates, depending on the amount of ink ejected by each printhead 340A-D, necessitating individual control of the ink supplied to each printhead reservoir 344A-D. Each of the ink level sensors 348A-D generates a signal at predetermined intervals corresponding to the amount of ink in the corresponding internal reservoir 344A-D, and the signals are delivered to the controller 380. When one of the sensors 348A-D detects that the ink level in the corresponding internal reservoir 344A-D is below a lower threshold, the controller 380 activates the corresponding thermoelectric device 320A-D to apply heat to the thermally conductive tube 224A-D, melting solid ink that is in blocking the corresponding thermally conductive tube 324A-D. In the embodiment shown in FIG. 3, the external ink reservoir 304 is positioned above the printheads 340A-D to enable gravity and fluid pressure to urge the liquid ink 360 to flow from the external reservoir 304, through any of the thermally conductive tubes 324A-D that are not blocked by solid ink, and into the corresponding internal reservoirs 344A-D. When the ink level sensor 348A-D corresponding to a heated thermoelectric device 320A-D detects that the ink level in the corresponding internal reservoir 344A-D is above an upper threshold, the controller 380 reverses the polarity of the electric power supplied to the heated thermoelectric device 320A-D, which cools the corresponding thermally conductive tube 324A-D. The phase change ink in the cooled thermally conductive tubes 324A-D solidifies, blocking the flow of ink through the tube and terminating the refill process.

Operation and control of the various components and functions of the ink transport system are performed with the aid of the controller. The controller can be implemented with general or specialized programmable processors that execute programmed instructions. The instructions and data required to perform the programmed functions are stored in memory associated with the processors or controllers. The processors, their memories, and interface circuitry configure the components of the system to perform the functions described above and the processes described below. The controller components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 4:
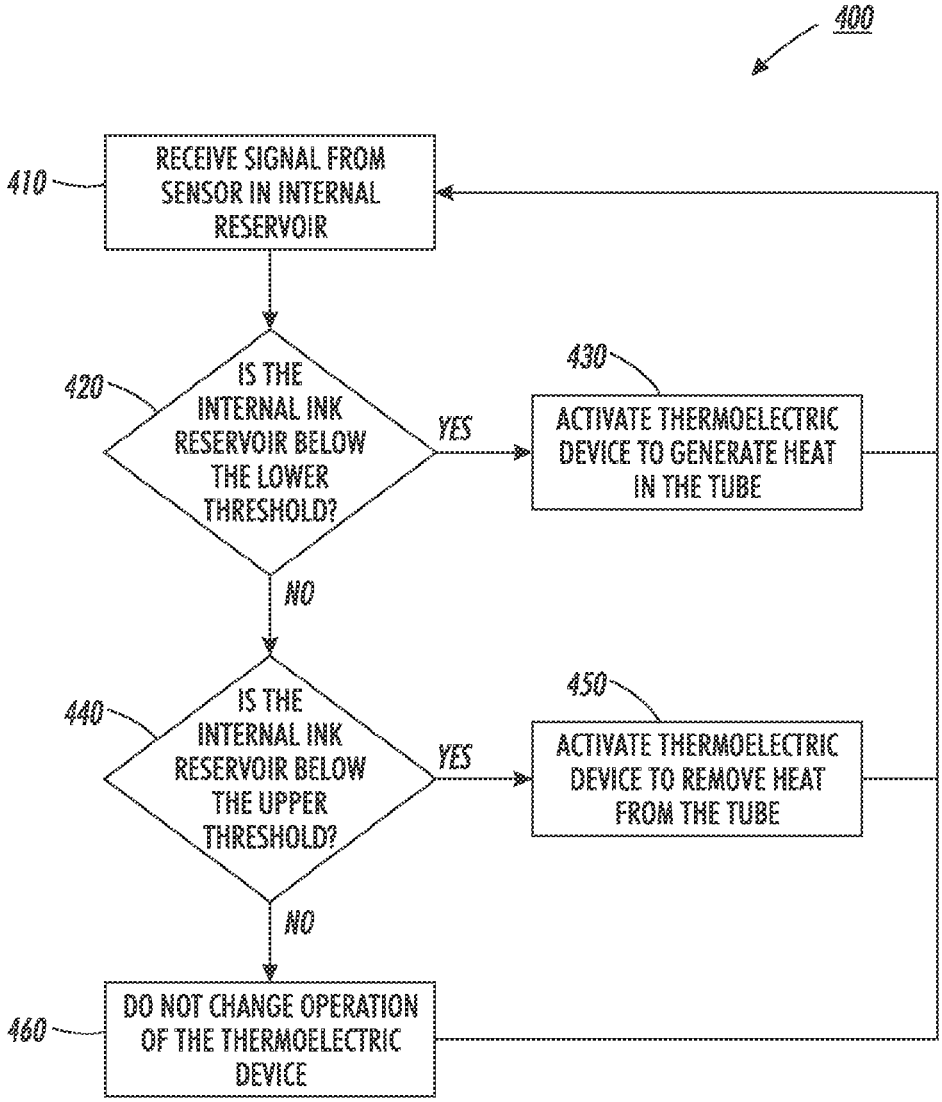
FIG. 4 is a process diagram of a process for transporting ink in a printer.

FIG. 4 depicts a process 400 for transporting ink to refill a printhead reservoir in a phase change ink printer. The process refers to a controller, such as the controllers 180, 280, and 380 described above, executing programmed instructions stored in a memory operatively connected to the controller to cause the controller to operate one or more components of the system to perform the specified function or action described in the process. The process 400 is illustrated for a system having a single internal reservoir. However, the reader will appreciate that the process can be performed in parallel for multiple thermoelectric devices in a printer with multiple internal reservoirs.

The process 400 begins with the controller receiving a signal from the sensor in the internal reservoir indicating an amount of ink in the internal reservoir (block 410). The controller then determines whether the amount of ink in the internal reservoir is below the lower threshold (block 420). If the amount is below the lower threshold, then the controller activates the thermoelectric device to generate heat in the tube (block 430), melting the ink in the tube and enabling ink to flow from the external reservoir to the internal reservoir, as described above. In the embodiment of FIG. 2 described above, this processing also includes operation of the pressure source to urge melted ink through the tube to the printhead. The process then repeats from block 410. If the amount of ink in the internal ink reservoir is not below the lower threshold, then the controller determines if the amount of ink in the internal reservoir is above the upper threshold (block 440). If the amount of ink is above the upper threshold, then the controller activates the thermoelectric device to remove heat from the tube (block 450), stopping flow of ink to the internal reservoir, and the process repeats from block 410. If the internal ink reservoir is neither above the upper threshold nor below the lower threshold, then the controller does not change the operation of the thermoelectric device (block 460). Thus, when the reservoir is between the lower and upper thresholds, the controller allows the reservoir to continue depleting until reaching the lower threshold or filling until reaching the upper threshold. In some embodiments, the controller is configured to deactivate the thermoelectric device after the ink in the tube has solidified, and the thermoelectric device remains off until the amount of ink in the internal reservoir falls below the lower threshold. The process then repeats from block 410.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink transport system comprising:

a thermally conductive tube having a first end that is fluidly connected to a first ink reservoir and a second end that is fluidly connected to a second ink reservoir to enable transport of melted phase change ink between the first ink reservoir and the second ink reservoir;

a thermoelectric device operatively connected to the thermally conductive tube;

a sensor configured to generate an electric signal corresponding to an amount of ink in the second ink reservoir; and a controller operatively connected to the thermoelectric device and to the sensor, the controller being configured to selectively operate the thermoelectric device at a first polarity to heat the thermally conductive tube to melt phase change ink within the thermally conductive tube to enable the phase change ink to flow from the first ink reservoir to the second ink reservoir in response to the electric signal from the sensor indicating that ink in the second ink reservoir is below a first predetermined threshold, and to remove heat from the thermally conductive tube to solidify the melted phase change ink within the tube to disable flow of the phase change ink from the first ink reservoir to the second ink reservoir.

2. The ink transport system of claim 1 further comprising:

a pressure source fluidly connected to the first ink reservoir; and the controller being operatively connected to the pressure source, the controller being further configured to operate the pressure source and apply pressure to ink within the first ink reservoir to urge melted phase change ink from the first ink reservoir to the second ink reservoir in response to a predetermined time expiring after the controller operates the thermoelectric device to melt phase change ink within the tube.

3. The ink transport system of claim 1, the first ink reservoir being positioned with respect to the second ink reservoir to enable gravity to urge melted phase change ink to flow from the first ink reservoir to the second ink reservoir in response to the phase change ink within the tube melting after operation of the thermoelectric device by the controller.

4. The ink transport system of claim 1, the second ink reservoir being located inside a printhead.

5. The ink transport system of claim 1 wherein the thermoelectric device is a Peltier device.

6. The ink transport system of claim 1 wherein the controller is further configured to control current direction through the thermoelectric device bi-directionally.

7. The ink transport system of claim 1, the controller being further configured to operate the thermoelectric device at a second polarity to remove heat from the thermally conductive device to solidify phase change ink in the thermally conductive tube in response to the electric signal from the sensor indicating that ink in the second ink reservoir is above a second predetermined threshold, the second polarity being opposite the first polarity.

8. An ink transport system comprising:

a first ink reservoir configured to hold a supply of phase change ink;

a plurality of printheads, each printhead in the plurality of printheads includes at least one internal ink reservoir;

a plurality of thermally conductive tubes, each tube in the plurality of thermally conductive tubes having a first end that is fluidly connected to the first ink reservoir to enable melted phase change ink from the first reservoir to enter each tube in the plurality of thermally conductive tubes and each tube in the plurality of thermally conductive tubes having a second end that is fluidly connected to only one of the at least one internal ink reservoir in the plurality of printheads and each second end of each thermally conductive tube is connected to a different internal ink reservoir than the other second ends of the other thermally conductive tubes in the plurality of thermally conductive tubes to enable each tube in the plurality of thermally conductive tubes to supply melted phase change ink to only one internal ink reservoir of one printhead in the plurality of printheads;

a plurality of thermoelectric devices, each thermoelectric device being operatively connected to only one of the thermally conductive tubes and each thermoelectric device being operatively connected to a thermally conductive tube that is different than the thermally conductive tubes to which the other thermoelectric devices in the plurality of thermoelectric devices are operatively connected; and a controller operatively connected to each thermoelectric device in the plurality of thermoelectric devices, the controller being configured to selectively operate each thermoelectric device independently of the other thermoelectric devices in the plurality of thermoelectric devices to heat independently each thermally conductive tube to melt phase change ink within each tube to enable melted phase change ink to flow from the first ink reservoir to the internal ink reservoir to which the tube is fluidly connected, and to remove heat independently from each thermally conductive tube to solidify the melted phase change ink within the tube to disable flow of the phase change ink from the first ink reservoir to the internal ink reservoir to which the tube is fluidly connected.

9. The ink transport system of claim 8 further comprising:

a pressure source fluidly connected to the first ink reservoir; and the controller being operatively connected to the pressure source, the controller being further configured to operate the pressure source and apply pressure to ink within the first ink reservoir to urge melted phase change ink from the first ink reservoir to at least one internal ink reservoir in response to a predetermined time expiring after the controller operates at least one thermoelectric device to melt phase change ink within the tube to which the at least one thermoelectric device is operatively connected.

10. The ink transport system of claim 8, the first ink reservoir being positioned with respect to the plurality of printheads to enable gravity to urge melted phase change ink to flow from the first ink reservoir to the internal ink reservoirs in the plurality of printheads in response to the phase change ink within at least one of the tubes melting after operation of the thermoelectric device operatively connected to the at least one of the tubes by the controller.

11. The ink transport system of claim 8 wherein the thermoelectric device is a Peltier device.

12. The ink transport system of claim 8 wherein the controller is further configured to control current direction through each thermoelectric device bi-directionally.

13. The ink transport system of claim 8 further comprising:

a plurality of sensors, each sensor in the plurality of sensors being associated with only one internal ink reservoir to enable each internal ink reservoir to be associated with only one sensor in the plurality of sensors and each sensor being configured to generate an electric signal corresponding to an amount of ink in the internal ink reservoir associated with the sensor; and the controller is operatively connected to each sensor in the plurality of sensors, the controller being further configured to operate each thermoelectric device at a first polarity to heat the thermally conductive tube operatively connected to the operated thermoelectric device to melt phase change ink in the thermally conductive tube in response to the electric signal from the sensor associated with the internal ink reservoir fluidly connected to the tube being heated indicating that ink in the internal ink reservoir associated with the sensor is below a first predetermined threshold.

14. The ink transport system of claim 13, the controller being further configured to operate each thermoelectric device at a second polarity to remove heat from the thermally conductive device operatively connected to the operated thermoelectric device to solidify phase change ink in the thermally conductive tube in response to the electric signal from the sensor associated with the internal ink reservoir fluidly connected to the tube being heated indicating that ink in the internal ink reservoir associated with the sensor is above a second predetermined threshold, the second polarity being opposite the first polarity.

15. A method of transporting ink in a printer comprising:

operating a thermoelectric device by enabling electrical current to flow in a first direction through the thermoelectric device to melt phase change ink in a thermally conductive tube fluidly connecting a first ink reservoir to a second ink reservoir to enable ink to flow from the first ink reservoir to the second ink reservoir;

generating with a sensor an electric signal corresponding to an amount of ink in the second ink reservoir; and operating the thermally conductive device to heat the thermally conductive tube to melt phase change ink in the tube in response to the electric signal indicating that ink in the second ink reservoir is below a first predetermined threshold, and by enabling electrical current to flow in a second direction that is opposite to the first direction to solidify phase change ink in the thermally conductive tube to disable flow of ink from the first ink reservoir to the second ink reservoir.

16. The method of claim 15 further comprising:

operating the thermoelectric device to remove heat from the thermally conductive tube to solidify phase change ink in the thermally conductive tube in response to the electric signal indicating that ink in the second ink reservoir is above a second predetermined threshold.

17. The method of claim 15, the second ink reservoir being positioned inside a printhead.

18. The method of claim 15 further comprising:

applying pressure to the first ink reservoir to facilitate flow of the phase change ink from the first ink reservoir to the second ink reservoir after a predetermined time period following operation of the thermoelectric device has expired.

* * * * *